United States Patent [19]

Miller

[11] Patent Number: 4,647,841

[45] Date of Patent: Mar. 3, 1987

[54] LOW VOLTAGE, HIGH PRECISION CURRENT SOURCE

[75] Inventor: Ira Miller, Tempe, Ariz.

[73] Assignee: Motorola, Inc., Schaumburg, Ill.

[21] Appl. No.: 789,605

[22] Filed: Oct. 21, 1985

[51] Int. Cl.[4] ..... G05F 3/20

[52] U.S. Cl. ..... 323/316; 307/495; 307/499; 330/257; 330/300

[58] Field of Search ..... 323/313-316; 307/296 R, 297, 495, 499, 570; 330/257, 288, 300

[56] References Cited

U.S. PATENT DOCUMENTS 3,914,683 10/1975 van de Plassche ..... 323/316
4,471,236 9/1984 Patterson, III ..... 323/315 X

FOREIGN PATENT DOCUMENTS 3419664 11/1984 Fed. Rep. of Germany ..... 323/315

*Primary Examiner*—Peter S. Wong

*Attorney, Agent, or Firm*—Michael D. Bingham

[57] ABSTRACT

A precision current mirror circuit includes first and second transistors the bases of which are coupled together and whose emitters are coupled to ground. The collector of the first transistor is connected to a reference current source for sinking a reference current therefrom while the collector of the second transistor is connected to an output of the current error for sinking a current at the output that substantially mirrors the reference current. A differential amplifier is provided having its non-inverting and inverting inputs coupled to the collectors of the first and second transistors respectively and its output connected to the bases of the two transistors such that the voltage that is established at the output of the current mirror is forced onto the collector of the first transistor. With the two transistors being matched the respective collector-base voltages therefore track which eliminates "Early" voltage errors as well as affects of the lower output impedances of the two transistors.

2 Claims, 4 Drawing Figures

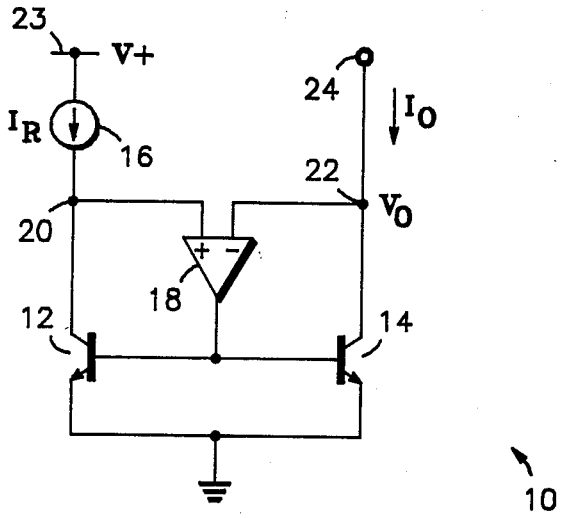
FIG. 1
FIG. 2
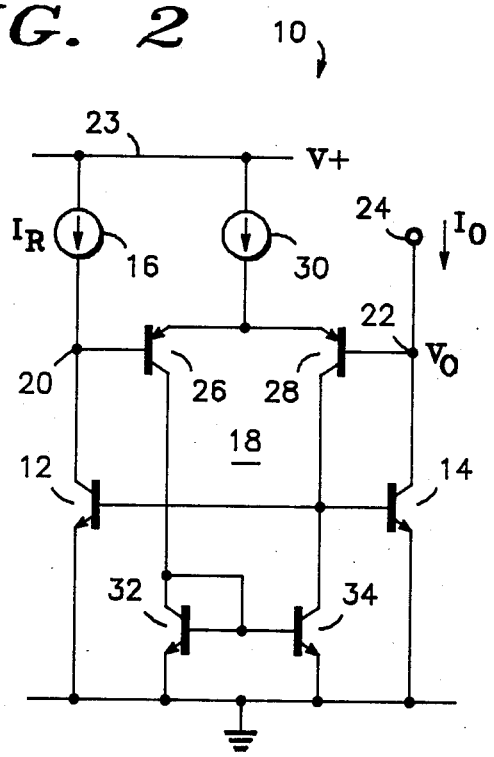

LOW VOLTAGE, HIGH PRECISION CURRENT SOURCE

BACKGROUND OF THE INVENTION

The present invention relates to current sources and, more particularly, to precision integrated transistor current sources.

Transistor current sources are widely used in integrated circuits as load devices, current scaling and bias elements. Such current sources can result in insensitivity of circuit performance to both power supply and temperature variations. Current sources are often more economical than resistors requiring less die area.

The most simplest prior art transistor current source consists of a reference current that is sourced to the collector of a first, diode-connected transistor. The base of this transistor, besides being connected to its collector, is connected to the base of a second transistor with both transistors having their respective emitters returned to ground reference. Since the two transistors have the same base-emitter voltage, the collector current of the second transistor is a function of the collector current of the first transistor as is understood. For example, by matching the emitter areas of the two transistors the collector currents will be substantially equal.

The above example ignores both the "Early" voltage effect as well as errors due to base current of the latter of which is a function of the forward current gain, beta, of the transistors. In typical bipolar linear integrated processes the betas of the transistors are quite high such that any errors due to base current can be neglected. The same is true for the "Early" voltage effect. However, in some present day low voltage digital integrated processes transistor betas can be very low when compared to those of the linear processes. In addition, the "Early" voltage effects can not be neglected. For instance, the ratio of the reference current to the current flowing in the second or output transistor can be as bad as 0.88 for base-emitter voltages of 0.7 volts. This is very undesirable.

Hence, a need exists for a low voltage precision current source that can be fabricated in integrated circuit form suing present day low voltage digital integrated processes.

SUMMARY OF THE INVENTION

Accordingly, it is an object of the present invention to provide an improved current source.

It is another object of the invention to provide a low voltage precision current source.

It is still another object of the invention to provide an integrated precision transistor current source.

Yet another object of the present invention is to provide a bipolar integrated precision transistor current source using a low voltage digital integrated process.

Still yet another object of the invention is to provide an integrated precision transistor current source.

Yet another object of the present invention is to provide a bipolar integrated precision transistor current source using a low voltage digital integrated process.

Still yet another object of the present invention is to provide a P-channel Metal-on-Silicon (PMOS)/NPN transistor current mirror.

In accordance with the foregoing and other objects there is provided a precision current source comprising first and second matched transistors each having first, second and control electrodes with the first and control electrodes of the first transistor coupled to the first and control electrodes of the second transistor, a reference current source coupled to the second electrode of the first transistor, and a differential amplifier having first and second inputs coupled respectively to the second electrodes of the first and second transistors and an output coupled to the control electrodes of the first and second transistors.

BRIEF DESCRIPTION OF THE DRAWINGS

FIG. 1 is a partial block and schematic diagram illustrating the current source of the present invention;

FIG. 2 is a detailed schematic diagram illustrating the current source of a first embodiment of the invention;

DETAILED DESCRIPTION OF THE PREFERRED EMBODIMENTS

Figure 3:
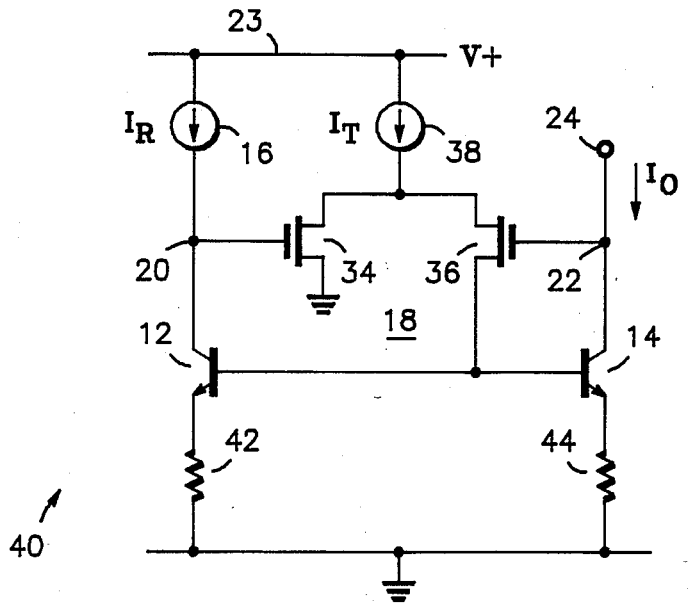
FIG. 3 is a schematic diagram illustrating the current source of another embodiment of the invention.

Turning to FIG. 1 there is shown a block diagram of precision current source 10 of the present invention. Current source 10 is suited to be manufactured in integrated circuit form and can be fabricated using present day low voltage integrated circuit fabrication processes. Current source 10 includes a pair of matched, i.e., equal emitter area transistors 12 and 14 which have their base or control electrodes coupled together. The emitters of first electrodes of the transistors are returned to ground reference. The collector of transistor 12 is coupled both to reference current source 16 and the non-inverting input of differential amplifier 18 at node 20. Reference current source 16, which is coupled to power supply conductor 23 to which is supplied a source of DC operating potential, sources a reference current $I_R$ to the collector of transistor 12. The inverting input of amplifier 18 is coupled to the collector of transistor 14 at node 22 to which an output current $I_o$ is produced. The output of amplifier 18 is coupled to the bases of transistors 12 and 14. The output of current source 10 is taken at output terminal 24.

In operation, output 24 is coupled to load circuitry (not shown) and the current $I_o$ sourced from node 22 which causes the voltage $V_o$ to be established thereat. Operational amplifier 18 causes the voltage at node 20 to be forced to the value $V_o$ while supplying base current drive to transistors 12 and 14. A quiescent operating state is established when transistor 12 is supplied sufficient base drive to enable it to sink substantially all of the current supplied from current reference 16. Since transistors 12 and 14 are matched devices and will have the same base-emitter voltage drop thereacross the current $I_o$ will be substantially equal to the current $I_R$. Moreover, because the voltage at node 20 is forced to be substantially equal to the voltage established at node 22 the collector-base voltage drops across the two transistors are also equal and will track each other. Thus, the effects of the "Early" voltage and beta process variations can be neglected and $I_o$ will equal $I_R$.

Turning now to the remaining Figures the several embodiments of current source 10 are shown in more detail. It is to be understood that the same components in the drawings are referenced by the same reference numerals. Operational amplifier 18 is illustrated in FIG. 2 a being formed by a differential amplifier comprising PNP transistors 26 and 28 the emitters of which are deferentially connected to current supply 30. The bases are coupled respectively to nodes 20 and 22 which correspond to the two inputs of amplifier 18. The collectors are coupled to a current mirror or differential to single ended converter comprised of diode connected transistor 32 and transistor 34. The current mirror is conventional in operation. Current supply 30 provides the "tail" current to the differential amplifier.

In operation, transistor 28 will be rendered conductive to supply the base currents to transistors 12 and 14 to turn these devices on until a balanced condition is reached where transistor 14 sinks the current $I_o$ from the load circuitry coupled to output 24. In this condition transistor 12 is driven sufficiently from transistor 28 to sink all of the current supplied from current supply 16. Transistor 26 is then sufficiently turned on by transistor 12 being rendered conductive to, in turn, render diode-connected transistor 32 conductive. This turns on transistor 34 such that transistor 28 provides the required base current drive to transistors 12 and 14 whereby the latter sources the current $I_o$ from node 24. Any variations in the voltage $V_o$ established at node 22 is forced onto node 20. Hence, the collector-base voltage drops across the transistors 12 and 14 track each other and operation of current source 10 of FIG. 2 is as described above with $I_o$ being substantially equal to $I_R$.

FIG. 3 illustrates another current source 40 which functions in the similar manner described above wherein operational amplifier 18 is realized by a pair of P-channel Metal-on-Silicon (PMOS) transistors 34 and 36. Current supply 38 provides the tall current $I_T$ at the deferentially connected drain electrodes of the two transistors. The gate electrodes of transistors 34 and 36 are coupled respectively to nodes 20 and 22 with the source electrode of transistor 34 being returned to ground reference and the drain of transistor 36 being coupled to the bases of transistors 12 and 14. The emitters of transistors 12 an 14 of current source 40 are returned to ground via respective resistors 42 and 44.

The operation of current source 40 is substantially the same as has been described above with regards to current source 10. Thus, the voltage at node 20 is forced to substantially the same voltage as is established at node 22 whereby the collector-base voltage developed across transistors 12 and 14 are maintained equal to one another and track variations in the voltage established at node 22. With the collector voltages and the base-emitter voltages of transistors 12 and 14 being equal the current $I_o$ sourced from output 24 essentially mirrors the current $I_R$ sourced by transistor 12 from current supply 16.

Figure 4:
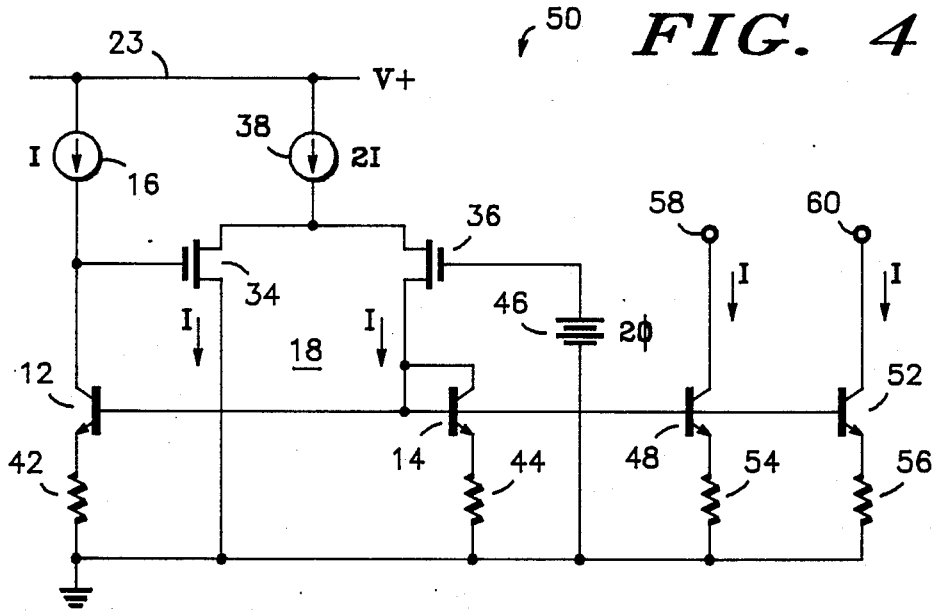
FIG. 4 is a schematic illustrating a current source of yet another embodiment of the invention.

Referring now to FIG. 4, there is shown precision, low voltage current source 50 of another embodiment of the invention in which a plurality of output currents are sourced through outputs 58 and 60 which each have a magnitude substantially equal to the value of the current I sourced from current supply 16. Current source 50 includes transistor 14, connected as a diode, coupled to the drain of PMOS transistor 36. A bias potential of magnitude 2 is applied to the gate of transistor 36. The potential established at the gate of transistor 34 is therefore forced to the same value. Current supply 38 provides a tail current of twice the value of the current source from current supply 16 to transistor 12. The tail current is equally divided and flows through both PMOS transistors. Hence, the current flowing through transistor 14 is substantially equal to that flowing through transistor 12. Output transistors 48 and 52 will mirror the current flowing in transistor 14 as their base to emitter paths are coupled in parallel to the latter via respective resistors 54 and 56. Since these output transistors are matched to transistor 14 the collector currents thereof will be equal to the collector current of the latter, i.e., equal to the value I. It is understood that any number of output transistors may be connected in the manner illustrated by transistor 48 and 52.

Hence, what has been described above are novel precision current sources for providing output currents that are substantially equal to a predetermined reference current in which "Early" voltage effects as well as base current error terminals can be neglected.

I claim:

1. A combined bipolar, MOS-integrated current source comprising:

a first current source for supplying a reference current;

a first bipolar transistor having an emitter, base and collector, said collector being coupled to said first current source, said emitter being coupled to a ground supply terminal;

a second current source providing a predetermined current at an output thereof;

first and second MOS transistors each having a drain, source and gate, said drains being interconnected to said output of said second current source, said gate of said first MOS transistor being coupled at said collector of said first bipolar transistor, said source of said first transistor being coupled to said ground supply terminal;

a second bipolar transistor the base of which is connected both to said base of said first bipolar transistor and said source of said second MOS transistor, the collector and emitter of said second bipolar transistor being coupled to said base thereof and said ground supply terminal respectively;

a bias supply for providing a bias potential to said gate of said second MOS transistor; and a third bipolar transistor the base of which is coupled to said base of said second bipolar transistor. the emitter being coupled to said ground supply terminal and the collector being coupled to an output of the current source to provide current thereat.

2. The current source of claim 1 including a fourth bipolar transistor having the base-emitter path thereof coupled in parallel with the base-emitter path of said third bipolar transistor and a collector coupled to a second output of the current source.

* * * * *

UNITED STATES PATENT AND TRADEMARK OFFICE

CERTIFICATE OF CORRECTION

PATENT NO. : 4,647,841

DATED : March 3, 1987

INVENTOR(S) : Ira Miller

It is certified that error appears in the above-identified patent and that said Letters Patent is hereby corrected as shown below:

In column 4, claim 1, line 37; delete the word "at" and insert therefor --to--; and In column 4, claim 1, line 50; after "transistor" delete the "." and substitute therefor a --,--.

Signed and Sealed this

Seventh Day of February, 1989

*Attest:*

DONALD J. QUIGG

*Attesting Officer*

*Commissioner of Patents and Trademarks*